US005255862A

United States Patent [19]

Chenest

[11] Patent Number: 5,255,862

[45] Date of Patent: Oct. 26, 1993

[54] EXPANDABLE PAPER ROLL SUPPORT

[76] Inventor: Gerard Chenest, Le Haut Mouchel, Saint Paer, 76480 Duclair, France

[21] Appl. No.: 801,589

[22] Filed: Dec. 5, 1991

Related U.S. Application Data

[63] Continuation of Ser. No. 532,690, Jun. 4, 1990, abandoned.

[30] Foreign Application Priority Data

Jun. 10, 1989 [GB] United Kingdom ..... 8913410

[51] Int. Cl.[5] ..... B65H 75/24

[52] U.S. Cl. ..... 242/72 R

[58] Field of Search ..... 242/72 R, 72 B, 72.1, 242/68.1, 68.2, 71.8, 46.4, 115; 269/48.1

[56] References Cited

U.S. PATENT DOCUMENTS

| | | | |
|---|---|---|---|
| 1,878,264 | 9/1932 | Claybourn | 242/72 R |
| 2,638,282 | 5/1953 | Prevost | 242/72 R |
| 2,733,022 | 1/1956 | Grady | 242/72 R |
| 3,166,335 | 1/1965 | Mason | 242/72 B |
| 3,323,743 | 6/1967 | Laudgraf | 242/68.3 |
| 3,462,092 | 8/1969 | Mullins | 242/46.4 |
| 3,829,147 | 8/1974 | Ryswick | 242/72 R X |
| 3,941,328 | 3/1976 | Johnson | 242/68.4 |
| 4,422,590 | 12/1983 | Rathbone | 242/68.3 |
| 4,880,152 | 11/1989 | Trankle | 242/72 R X |

*Primary Examiner*—Daniel P. Stodola
*Assistant Examiner*—John P. Darling
*Attorney, Agent, or Firm*—Whitham & Marhoefer

[57] ABSTRACT

A support for a roll of paper or similar material. The support comprises a shaft divided into two portions (10 and 11). The inner end of the portion (11) is internally threaded to receive an externally threaded boss (1) on the portion (10) The boss (14) carries a rubber ring (17) located between two washers (16 and 18). When the two portions (10 and 11) are assembled, the ring (17) is squeezed between the washers (16 and 18) so that its diameter expands until it grips the interior of the paper roll.

1 Claim, 4 Drawing Sheets

EXPANDABLE PAPER ROLL SUPPORT

This application is a continuation of Ser. No. 07/532,690, filed Jun. 4, 1988, now abandoned.

BACKGROUND OF THE INVENTION

1. Field of the Invention

This invention relates to supports for rolls of material.

In many different types of apparatus a roll of flexible material such as paper has to be supported on a rotatable shaft. Particularly in the case of paper, the roll is normally wound on a tube which may consist, for example, of cardboard or of a synthetic resin material. In some cases the tube may be allowed to rotate freely on the shaft, for example while material is paid off from the roll.

2. Description of the Prior Art

In the past, when it has been necessary for the roll of material to rotate with the shaft, various different methods have been used to lock the tube to the shaft. In one system, end cheeks have been provided on the shaft and these have been urged towards each other to grip the ends of the tube, either by means of a spring or by means of a positive compression device such as a screw. In other systems a slot has been provided in one or both ends of the tube and this slot has engaged with a corresponding ridge on the cheek or cheeks. In yet another system, spring means have been provided on the shaft itself to grip the interior of the tube. These have frequently been unsatisfactory because of variations in the internal diameter of the tube. Also difficulty has sometimes been experienced in mounting the tube on an axle provided with spring means, in that the spring has caught in the interior of the tube, particularly in the case of cardboard tubes.

It is an object of the present invention to provide a system for supporting a roll of material on a shaft, which system avoids the disadvantages of the known systems.

In accordance with the invention the shaft includes at least two portions, one of which is internally threaded to receive an externally threaded boss on one end of the other portion so that the two portions can be assembled coaxially. The boss carries an annular elastomeric member, the external diameter of which, when the two portions are not assembled, is less than the internal diameter of the roll, whereas, when the two portions are assembled, pressure on the annular member from the adjacent ends of the two shaft portions increases its external diameter at least to the internal diameter of the roll.

It is to be understood that in this definition of the invention the word "roll" is being used to refer both to an unsupported roll of material and also to a roll of material supported on a tube. Thus in the case of a roll supported on a tube, the internal diameter referred to in the preceding paragraph is the internal diameter of the tube.

The elastomeric material of the annular member is preferably natural or synthetic rubber, but may be any other suitable material which, when compressed axially, will expand radially and will return to its initial dimensions when the axial pressure is removed.

In some cases, and especially when the axial length of the roll is relatively large, it will be desirable to provide two or more elastomeric annular members in the shaft so that the gripping pressure is applied evenly along the length of the interior of the roll or the tube on which it is mounted In such cases the shaft is of course divided into the appropriate number of portions to accommodate the required number of annular members.

BRIEF DESCRIPTION OF THE DRAWINGS

The foregoing and other objects, aspects and advantages will be better understood from the following detailed description of a preferred embodiment with reference to the drawings, in which:

Referring to FIG. 1, it will be seen that the shaft comprises a first portion 10 and a second portion 11. An end cheek 12 is secured to the portion 10 and an end cheek 13 is secured to the portion 11. The end of the portion 10, remote from the cheek 12, is provided with a boss 14. The inner end of the boss 14 is smooth, while the outer end is threaded as shown at 15. The inner end of the boss 14 carries a rigid washer 16, an annular elastomeric member 17 and a further rigid washer 18. A groove 19 is provided in the smooth part of the boss 14, and the two washers 16 and 18 and the annular member 17 are retained in position by means of a circlip 20. As can be seen, the external diameter of the circlip 20 is less than that of the washer 18.

Figure 1:
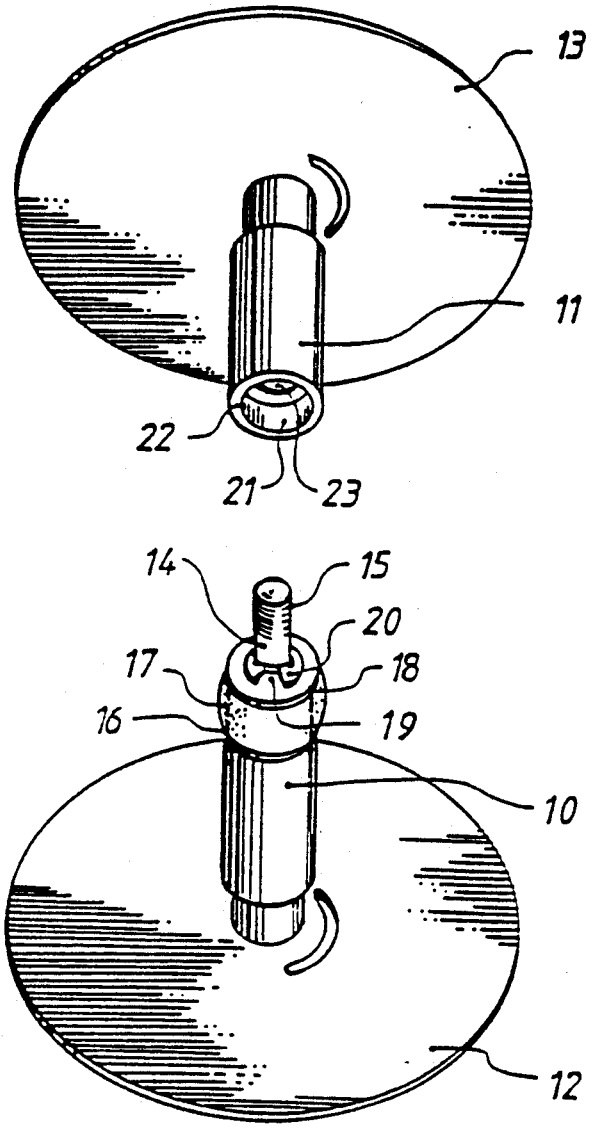
FIG. 1 is an exploded view of a roll support in accordance with the invention showing the two portions of the shaft separated.

The end of the shaft portion 11, remote from the cheek 13, is provided with a recess 21 forming an annular shoulder 22. The internal diameter of the annulus is greater than the external diameter of the circlip 20, but less than the external diameter of the washer 18. The end of the portion 11, remote from the cheek 13, is provided with a further bore 23 which is threaded to cooperate with the thread 15 on the boss 14. Thus the two shaft portions 10 and 11 can be assembled coaxially by providing relative rotation between the two portions. As a result of this relative rotation the threaded portion 15 of the boss 14 is drawn into the bore 23, and the circlip 20 enters the recess 21. However the washer 18 cannot enter this recess, and butts up against the shoulder 22. Thus continued relative rotation of the two shaft portions forces the washer 18 towards the washer 16 and thus compresses the annular member 17. The axial pressure on the member 17 causes its external diameter to increase from a pre-compressed value shown in broken line in FIGS. 1, 2, 4 and 5, and thus grip the interior of the tube or roll of material which is mounted on the two shaft portions 10 and 11.

Figure 2:
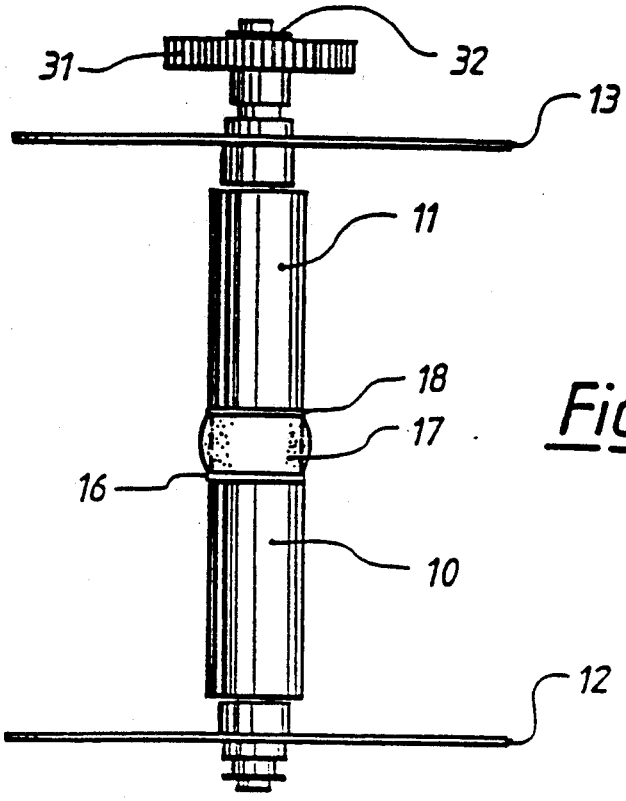
FIG. 2 is a plan view of the support of FIG. 1 in the assembled position.

FIG. 2 is a plan view of the support illustrated in FIG. 1, with the two shaft portions assembled It can be seen that a drive cog 31 is provided on the shaft portion 11 and is held in place with a circlip 32. A flat, or spine, is provided on the shaft portion 11 to ensure that the portion rotates with the cog 31 so that the whole assembly can be driven. The end cheek 13 may be similarly secured to the shaft portion 11 or it may be allowed to rotate relative thereto. To facilitate the production of relative rotation between the two shaft portions 10 and 11 it is, however, desirable that the end cheek 12 should be locked to the portion 10.

Figure 3:
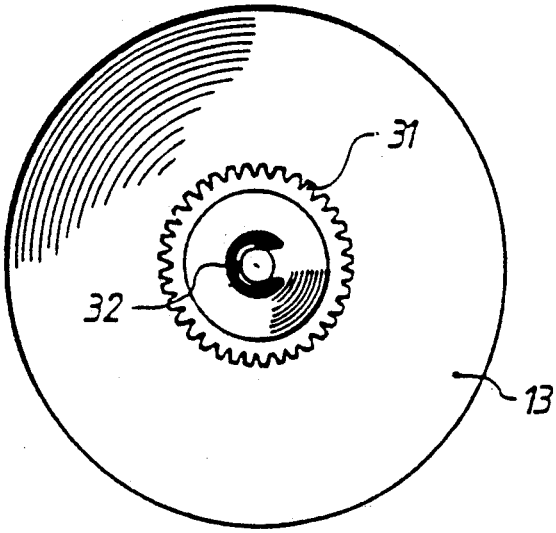
FIG. 3 is an end view of the support illustrated in FIG. 2.

FIG. 3 is an end view of the support shown in FIG. 2 illustrating the cog 31 and the circlip 32.

Figure 4:
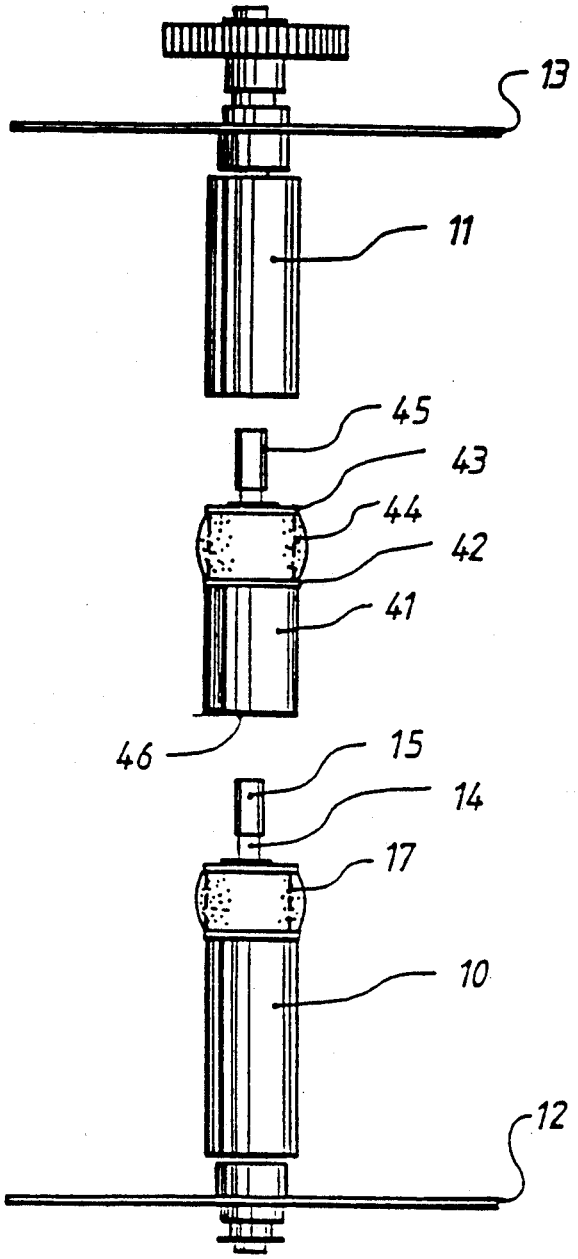
FIG. 4 is a plan view of a second embodiment of the invention in which two annular members are provided.

FIG. 4 illustrates an embodiment of the invention generally similar to that illustrated in FIGS. 1 to 3 except that an intermediate shaft portion 41 is included between the two shaft portions 10 and 11. The intermediate portion 41 is provided with washers 42 and 43 cooperating with an annular elastomeric member 44. The portion 41 also has a threaded boss 45 which can be inserted into a threaded bore in the open end of the portion 11. Similarly the lower end 46 of the intermediate portion 41 is designed in the same way as the open end of the portion 11 to receive the threaded portion 15 of the boss 14 on the shaft portion 10.

It will be seen that with the arrangement shown in FIG. 4, the two annular members 17 and 44 will grip the interior of the roll of material, or the tube on which the roll is carried, when relative rotation is provided between the portions 10 and 11. Normally, for ease of assembly, it will be desirable before putting the roll of material in place to attach the intermediate portion 41 to one or other portions 10 and 11 without applying sufficient pressure to increase the diameter of either of the annular members.

Figure 5:
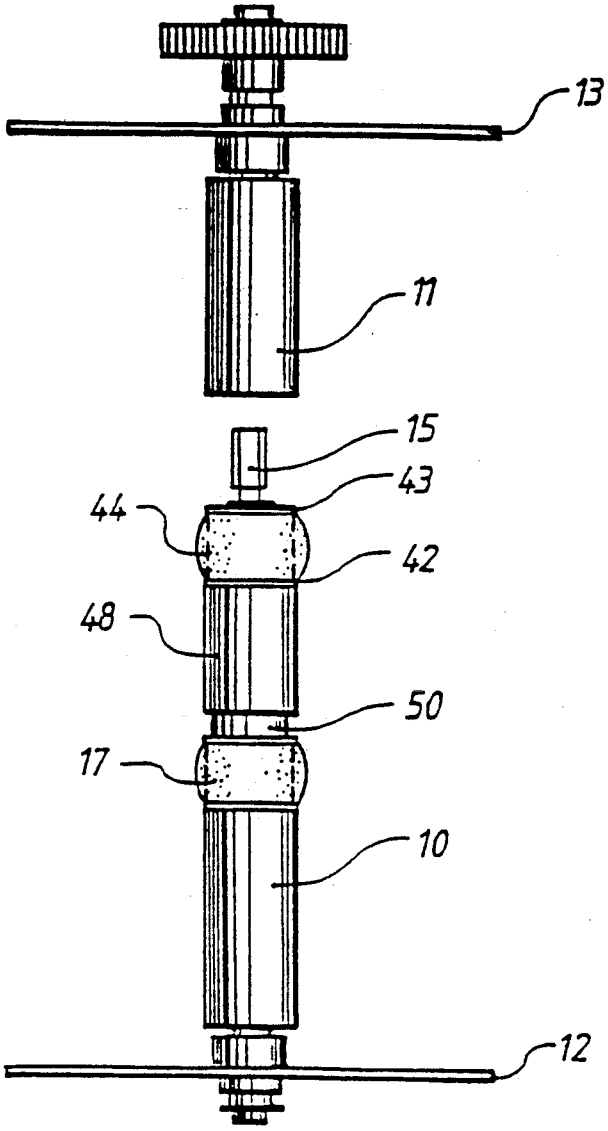
FIG. 5 is a plan view of a third embodiment in which two annular members are also provided.

FIG. 5 shows a plan view of a third embodiment of the invention in which two annular members 17 and 44 are again provided. The embodiment of FIG. 5 is generally similar to that illustrated in FIG. 4 except that the first member 10 is retained as a single, integral part and the intermediate shaft portion 41 is replaced by a sliding sleeve 48 free to slide on a cylindrical portion 50 of the first member 10, between the annular elastomeric member 44 and the annular elastomeric member 17. The visible gap between the sliding sleeve 48 and the cylindrical shaft 50 on the first member 10 is exaggerated in FIG. 5 for purposes of illustration. As a second member 11 is screwed on to the first member 10, so the sliding sleeve 48 is urged downwards by the elastomeric member 44 against the elastomeric member 17 so that both are compressed and increase their respective radii.

It is to be understood that, whereas FIGS. 4 and 5 have shown two annular elastomeric members 17 and 44, three or more elastomeric members can be provided, being compressed either as illustrated in FIG. 4, or as shown in FIG. 5, or by a combination of the methods shown and described with reference to FIGS. 4 and 5.

While the invention has been described in terms of a single preferred embodiment those skilled in the art will recognize that the invention can be practiced with modification within the spirit and scope of the appended claims.

Having thus described my invention, what I claim as new and desire to secure by Letters Patent is as follows:

1. A support for both sides of a roll of material comprising, in combination:

a shaft whose diameter is less than the internal diameter of the roll extending from a journal at a first end of said shaft supporting a said first end of said shaft, to a second journal at a second end of said shaft supporting said second end of said shaft;

said shaft including at least three portions, one end of a first portion of the shaft including a first internally threaded recess adapted to receive a first externally threaded boss integral with one end of a second portion of the shaft so that the first and second portions of the shaft can be joined co-axially;

another end of the second portion of the shaft including a second internally threaded recess adapted to receive a second externally threaded boss integral with one end of a third portion of the shaft so that the second and third portions of the shaft can be joined coaxially;

a first annular elastomeric member being carried by said first boss, and a second annular elastomeric member being carried by said second boss;

each of said first and second annular elastomeric members having an uncompressed diameter which is less than the internal diameter of the roll; where when the first and second portions of said shaft are assembled, said first and second portions of said shaft engage said first annular elastomeric member therebetween for pressure on said first annular elastomeric member from the adjacent ends of the said first and second portions of said shaft to increase the external diameter of said first annular elastomeric member at least to the internal diameter of the roll; where when the second and third portions of said haft are assembled, said second and third portions of said shaft engage said second annular elastomeric member therebetween for pressure on said second annular elastomeric member from the adjacent ends of the said second and third portions of said shaft to increase the external diameter of said second annular elastomeric member at least to the internal diameter of the roll; and where the compressed diameter of said first annular elastomeric member can be adjusted independently of the compressed diameter of said second annular elastomeric member.

* * * * *